United States Patent [19]

Ellis

[11] Patent Number: 4,975,034

[45] Date of Patent: Dec. 4, 1990

[54] REVERSIBLE DISPLACEMENT PUMPS

[76] Inventor: Thomas E. Ellis, P.O. Box 13, Forest Range, South Australia, Australia

[21] Appl. No.: 331,244

[22] Filed: Mar. 31, 1989

[51] Int. Cl.[5] ..... F04C 2/328

[52] U.S. Cl. ..... 418/265

[58] Field of Search ..... 418/265, 29, 24, 25, 418/26, 27

[56] References Cited

U.S. PATENT DOCUMENTS

| | | | |
|---|---|---|---|
| 863,832 | 8/1907 | Boland | 418/265 |
| 1,153,873 | 9/1915 | Shore | 418/265 |
| 2,470,670 | 5/1949 | Winkler et al. | 418/265 |
| 3,373,723 | 3/1968 | Blosser | 418/265 |
| 4,239,466 | 12/1980 | Abbey | 418/27 |

FOREIGN PATENT DOCUMENTS 447808 1/1973 Australia .

*Primary Examiner*—John J. Vrablik
*Assistant Examiner*—David L. Cavanaugh
*Attorney, Agent, or Firm*—Brown, Martin, Haller & McClain

[57] ABSTRACT

A pump has a cylindrical casing, a discoid rotor in the casing having arms each extending in an axial direction from the rotor and sliding over the inner surface of the casing upon rotor rotation, each arm having a flap pivoted at one end to that arm and having its other end slidably engaging a curved surface of an adjacent arm. An inner member freely rotates over an eccentric shaft and is coupled by links to the flaps so that, upon rotation, the flaps pivot towards and away from the casing to effect pumping action. Each arm, flap, link, and the inner member is of constant cross-sectional shape, so that production costs are low.

5 Claims, 2 Drawing Sheets

REVERSIBLE DISPLACEMENT PUMPS

This invention relates to improvements in reversible variable capacity positive displacement pumps or the type described in my now expired Australian Pat. No. 447,808.

BACKGROUND OF THE INVENTION

In that patent specification there was disclosed a pump wherein the plurality of circumferentially spaced arms were driven within a cylindrical housing, and between adjacent arms there were arranged flaps which pivoted about axial pivots to vary the displacement volume between the flaps and the inner surface of the housing, the degree of pivoting being controlled by eccentricity of a ring coupled to those flaps by respective links. Each link was pivoted at its radially outer end to a respective flap, and all but one was pivoted to a ring, the one which was not pivoted being an extension of the ring fixed with respect to the ring. Although searches have been made, the Applicant knows of no other prior art pump which utilises that principle.

Pumps made in accordance with that patent have proved particularly successful technically for pumping many materials which are otherwise difficult to pump, and very efficient in that the horse power requirement for pumping a volume at a rate was less than with most other pumps, for example, about half that required for a centrifugal pump wherein a great deal of fluid friction is developed.

BRIEF SUMMARY OF THE INVENTION

The main object of this invention is to provide improvements in such pumps so that they can be manufactured for relatively low cost, and in an embodiment of this invention, improvements comprise a part-circular recess in each respective circumferentially spaced rotor arm, a part-circular lobe on one end of each flap pivotally engaging a respective part-circular arm recess to constrain the flap to pivotal movement, a part circular recess in each respective said flap, and a part circular lobe on each coupling means pivotally engaging a respective said flap recess, the cross-sectional shape of each respective arm, and of each respective flap, being constant throughout its length.

With this invention, the rotor arms, flaps, links and inner member, can all be merely lengths of constant section extrusions, although use can alternatively be made of injection molded parts, which can be of metal or plastics material.

BRIEF SUMMARY OF THE DRAWINGS

An embodiment of the invention is described hereunder in detail with reference to, and is illustrated in, the accompanying drawings, in which.

Figure 1:
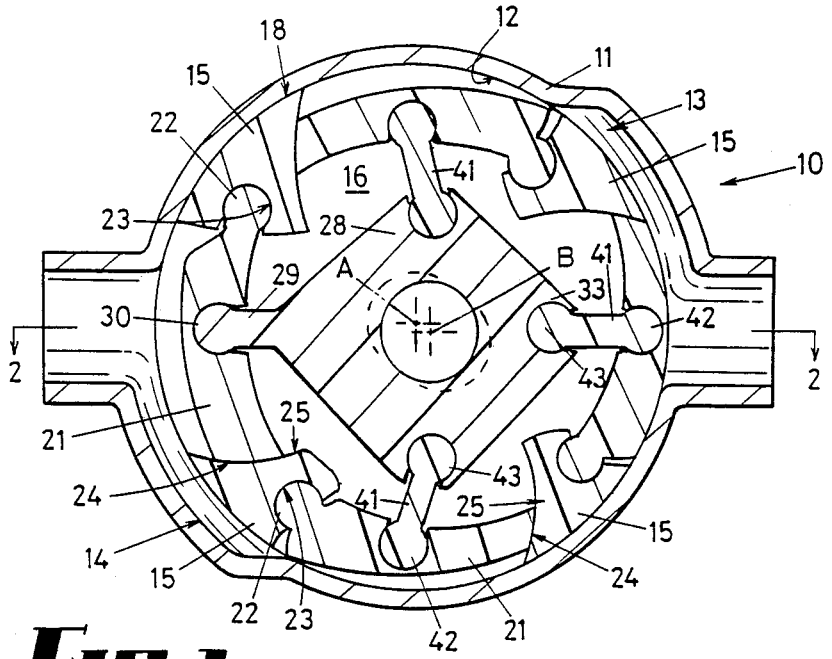
FIG. 1 is a central plan section through a pump.
Figure 2:
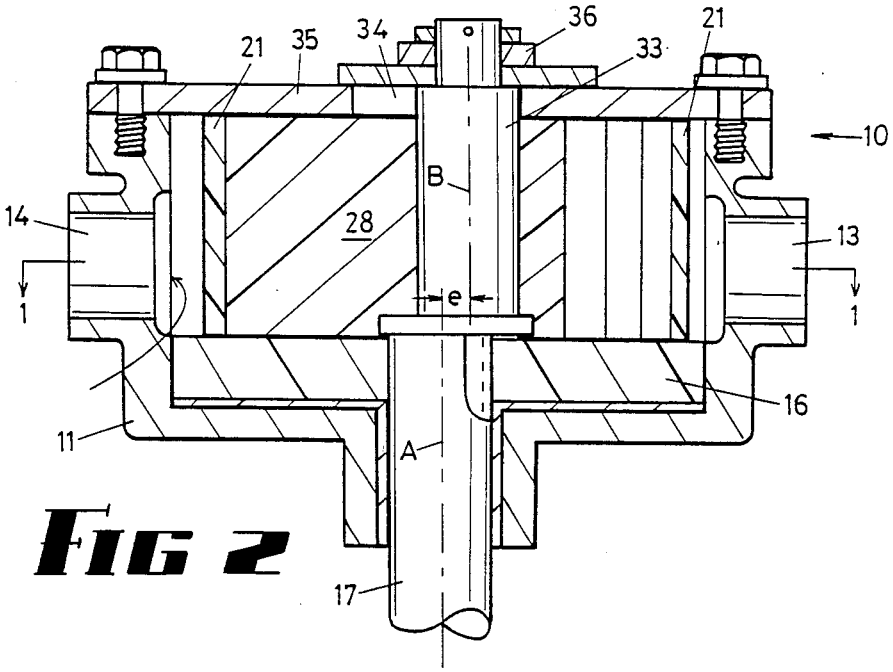
FIG. 2 is a cross-section taken on line 2—2 of FIG. 1 (also showing the sectional plane of FIG. 1), and, FIG. 3 is a diagrammatic representation which illustrates an automatic pressure control means.

In this embodiment, a pump 10 has a cylindrical casing 11 with a generally cylindrical surface 12 except at the location of the ports 13 and 14. Four rotor arms 15 extend from a driven discoid rotor 16 in an axial direction, and are driven for rotation by a driving shaft 17. The outer surfaces 18 of the arms 15 are part cylindrical in shape so that the arms 15 make a circumferential seal with the cylindrical surface 12 of the cylindrical casing 11.

Between each pair of adjacent arms 15 there is provided a respective flap 21, each flap 21 having a part circular section lobe 22 at one end which is pivoted in part circular recess 23 in a respective arm 15, and the other end has a curved surface 24 which is curved cylindrically with respect to the central cylindrical axis of lobe 22 and which bears against a complementary curved surface 25 of an adjacent arm 15. Since this is a wearing part, the end may comprise an adjustable extension which is readily adjusted by slackening clamping screws and sliding outwardly before reclamping. This is not illustrated.

Figure 3:
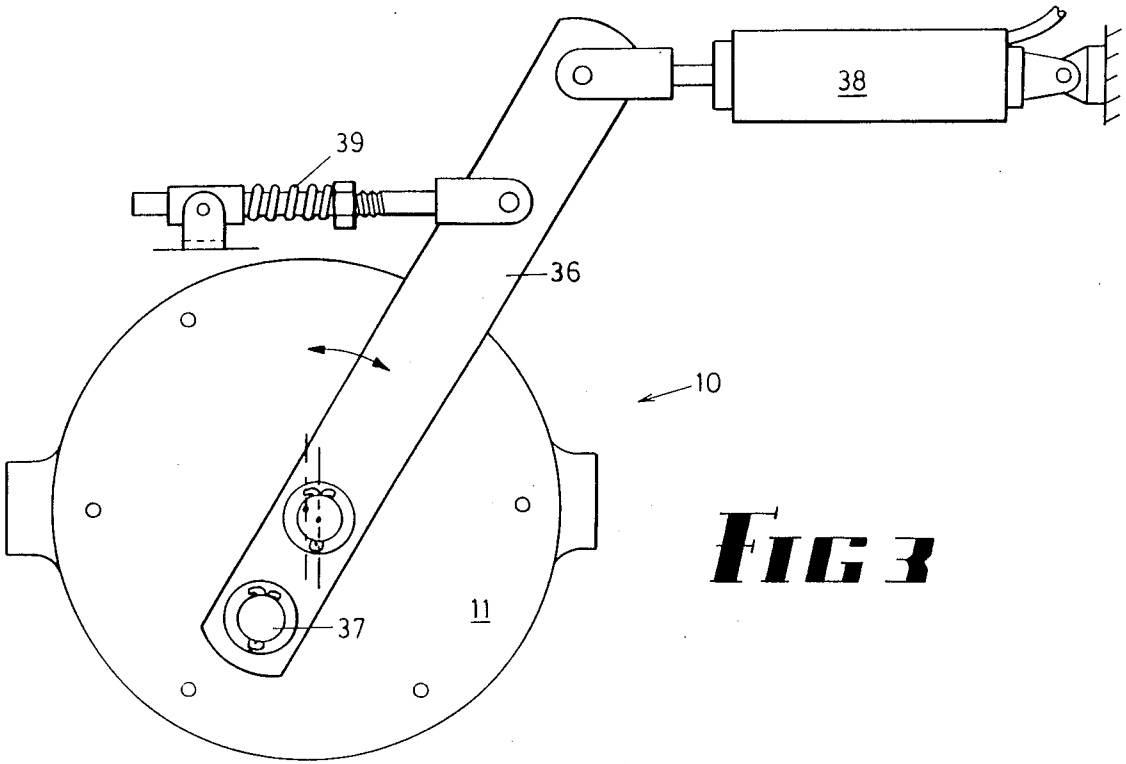

There is provided a freely rotating inner member 28 which however has projecting from part of it a lug 29 which terminates at its end in a lobe 30 in one of the flaps 21. The axis of rotation of rotor 16 is designated A, and this is eccentric with respect to the axis of rotation B of the inner member 28, B being a central axis of a secondary shaft 33. The secondary shaft B is movable in a slot 34 in an end plate 35 of the casing 11, and it can be clamped in position, for example, by a nut. However, in the embodiment described, its location is controlled by a lever arm 36 pivoted to casing 11 at 37, to vary the degree and direction of eccentricity. As shown in FIG. 3, lever arm 36 is controlled by an hydraulic cylinder 38 co-acting against spring 39. As pressure from pump 11 expands the piston/cylinder assembly 38, eccentricity reduces and flow reduces as pressure increases.

Referring back to FIG. 1, links 41 join the inner member 28 to respective flaps 21, and upon rotation these links pivot with respect to inner member 28 and also with respect to flaps 21. Each link 41 has a constant cross-sectional shape and terminates at its ends in circular lobes 42 and 43 and these engage respective recesses in the flaps 21 and the inner member 28.

The function of the pump is similar to what was described in said U.S. Pat. No. 447,808. Furthermore the efficiency which can be achieved is similar to that which can be achieved by a pump as described in that patent specification. However, the cost of the pump is very considerably reduced owing to the ability to use constant section members which can be extruded or produced by injection moulding, particularly for the links 41 and the flaps 21. Other elements of the pump can also be produced in this manner, the necessary design changes having been made by this invention.

I claim:

1. In a pump comprising a driven rotor on a driving shaft and having a plurality of axially extending and circumferentially spaced rotor arms thereon and slidably and sealably engaging a cylindrical inner surface of a casing, flaps pivoted each at one end to a respective said rotor arm and slidably engaging a curved surface of an adjacent said arm, so that, upon rotation of said rotor, movement of said flaps varies displacement volume between each flap and said cylindrical inner surface, an inner member rotatable about an eccentric secondary shaft parallel to the driving shaft, and links coupling all but one of respective said flaps to the inner member, the improvement comprising a part-circular recess in each respective said circumferentially spaced rotor arm, a part-circular lobe on one end of each said flap pivotally engaging a respective said circular arm recess to constrain the flap to pivotal movement, a part-circular recess in each respective said flap, and a part-circular lobe on each said coupling link pivotally engaging a respective said flap recess, the cross-sectional shape of each respective flap, of each respective arm, of each respective coupling link and of said inner member being constant throughout its axial length.

2. The improvement according to claim 1 further comprising one lug extending outwardly from the inner member in a radial direction and terminating in a said part-circular lobe which engages the said recess of said one flap.

3. The improvement according to claim 2 wherein said coupling means further comprises a plurality of links each with a part-circular lobe at each respective end, one lobe of each link engaging the said part-circular recess of a flap and the other lobe of that link engaging a similar part-circular recess in the inner member.

4. The improvement according to claim 1 wherein said casing comprises an end plate having a slot therein, the secondary shaft on which said inner member is journalled for rotation extending through said slot, and means for moving the said secondary shaft in the slot to control the degree of eccentricity of said secondary shaft with respect to said driving shaft.

5. The improvement according to claim 4 wherein said eccentricity control means comprises a lever arm pivoted with respect to said casing and movable by an hydraulic cylinder acting against a spring in such a way that increase of pressure from the pump when applied to the hydraulic cylinder reduces eccentricity and there by reduces flow.

* * * * *